US006979056B1

(12) United States Patent
Goldszer

(10) Patent No.: US 6,979,056 B1
(45) Date of Patent: Dec. 27, 2005

(54) BEACH CHAIR WITH MOVABLE SHADE

(75) Inventor: Jacob Goldszer, Weston, FL (US)

(73) Assignee: JGR Copa, LLC, Hollywood, FL (US)

( * ) Notice: Subject to any disclaimer, the term of this patent is extended or adjusted under 35 U.S.C. 154(b) by 0 days.

(21) Appl. No.: 10/984,654

(22) Filed: Nov. 9, 2004

(51) Int. Cl.[7] ..... A47C 7/62
(52) U.S. Cl. ..... 297/184.15; 297/28; 297/39; 297/22; 297/184.1
(58) Field of Search ..... 297/19, 24, 27, 297/28, 31, 38, 39, 46, 184.14, 184.11, 184.1, 297/184.12, 184.15

(56) References Cited

U.S. PATENT DOCUMENTS 1,258,045 A * 3/1918 Premysl ..... 297/52
1,939,568 A * 12/1933 Panhorst ..... 297/28
2,051,254 A * 8/1936 Haberstump ..... 297/21
2,752,929 A * 7/1956 Berger ..... 297/31
2,837,140 A * 6/1958 Hedman ..... 297/22
4,230,363 A * 10/1980 Borichevsky ..... 297/184.15
5,582,458 A * 12/1996 Wildt ..... 297/184.15
5,707,105 A * 1/1998 Liu ..... 297/40
6,056,172 A * 5/2000 Welsh ..... 224/155
6,761,397 B1 * 7/2004 Tseng ..... 297/40

* cited by examiner

*Primary Examiner*—Laurie K. Cranmer
(74) *Attorney, Agent, or Firm*—Robert C. Kain, Jr.; Fleit Kain

(57) ABSTRACT

The folding chair with a movable shade includes a back support frame and a flexible back support, a seat support frame and a flexible seat and a cross frame member pivotally mounted between the back frame and the seat support frame to provide an angular seating position for the user. A shade member includes a shade frame and a shade element. The shade member is pivotally mounted to a top portion of the back support frame. A control member coupled either to the shade frame or the back support frame establishes the angular shade position of the shade with respect to the back support and the seat support.

22 Claims, 2 Drawing Sheets

BEACH CHAIR WITH MOVABLE SHADE

The present invention relates to a folding beach chair with a movable shade.

BACKGROUND OF THE INVENTION

Folding beach chairs are well known. Typical beach chairs include a back support frame upon which is mounted a flexible back support, a seat support frame and a mounted flexible seat as well as a cross frame member that is pivotally mounted between the back support frame and the seat support frame which establishes the angular seating position between the back support and the seat support. Additionally, these folding beach chairs typically are hinged such that the back support can be positioned adjacent the seat support and the user can carry the collapsed beach chair.

As used herein, the term "beach chair" is not meant to limit the folding chair invention to chairs solely employed or utilized on a beach. As is commonly known, these types of folding chairs are used on patios, at sporting events, and in parks and recreational areas, in addition to being utilized on the beach.

OBJECTS OF THE INVENTION

It is an object of the present invention to provide a folding beach chair with a movable shade which can be utilized by a person seated in the beach chair to provide shade to that person.

It is an additional object of the present invention to provide a movable shade which can be positioned at multiple angular shade positions.

It is a further object of the present invention to provide a folding chair wherein the shade can be collapsed against the back support for easy transport and handling by a user.

It is an additional object of the present invention to incorporate a cushion along the rear shade frame element, which cushion provides additional comfort to the head of a person seated in the folding chair.

SUMMARY OF THE INVENTION

The folding chair with a movable shade includes a back support frame and a flexible port, a seat support frame and a flexible seat and a cross frame member pivotally mounted the back frame and the seat support frame to provide an angular seating position for the shade member includes a shade frame and a shade element. The shade member is pivotally to a top portion of the back support frame. A control member coupled either to the shade the back support frame establishes the angular shade position of the shade with respect to support and the seat support.

BRIEF DESCRIPTION OF THE DRAWINGS

Further objects and advantages of the present invention can be found in the detailed description of the preferred embodiments, when taken in conjunction with the accompanying drawings in which.

DETAILED DESCRIPTION OF THE PREFERRED EMBODIMENTS

The present invention relates to a folding beach chair (or other type of light weight, portable, folding chair) with a movable shade.

Figure 1:
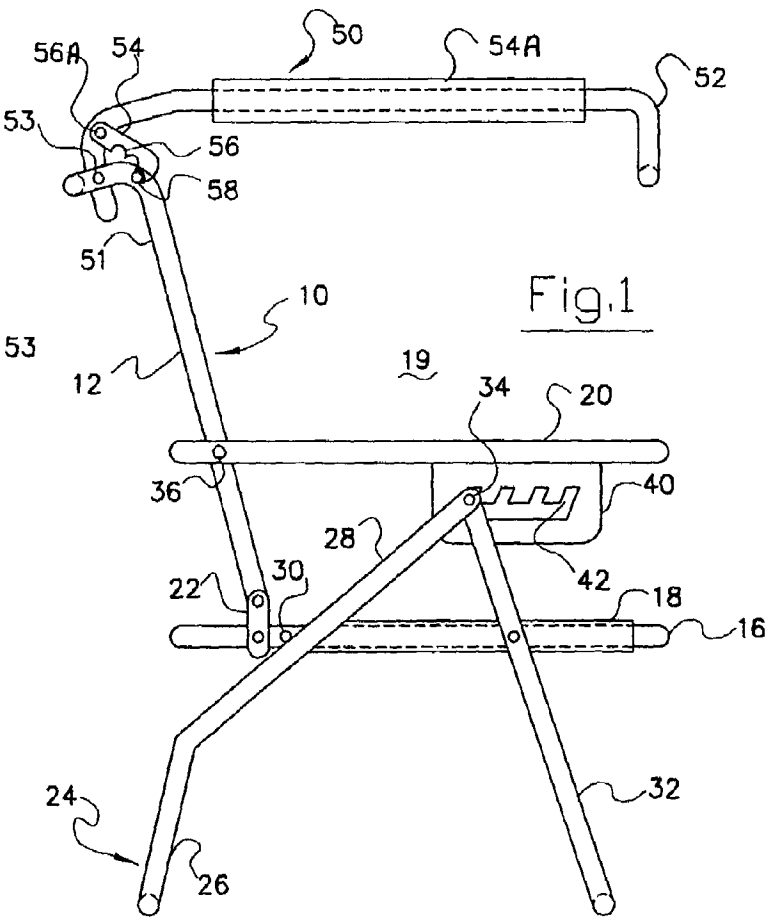
FIG. 1 diagrammatically illustrates a side elevational view of the folding beach chair dance with the principles of the present invention.
Figure 4:
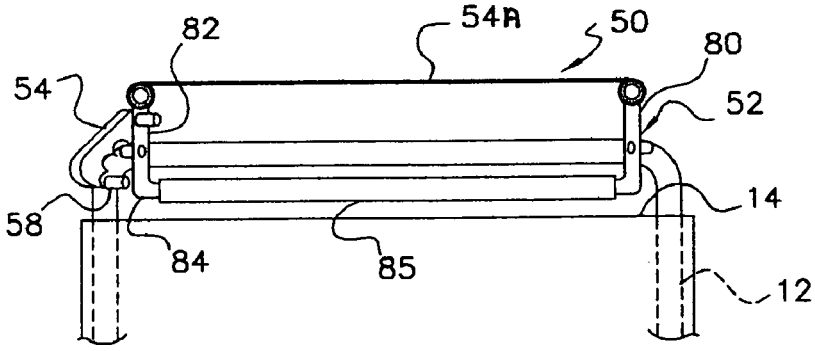
FIG. 4 diagrammatically illustrates a partial front end view showing the cushion on the rear shade frame element.

FIG. 1 diagrammatically illustrates a side elevational view of folding beach chair or folding chair 10. Chair 10 includes a back support frame 12. Similar numerals designate similar items throughout the drawings. As shown in FIG. 4, back support frame has, mounted thereon, a flexible back support 14. Returning to FIG. 1, chair 10 includes a seat support frame 16 and a flexible seat 18 adapted for use by a person seated in region 19 of folding chair 10. Chair 10 also includes a cross frame member 20. Back support frame 12 is hinged to seat support frame 16 with a hinged plate 22. Hinged plate 22 is rotatably connected at one end to back support frame 12 and is rotatably connected at its other end to seat support frame 16. Other hinge or pivot systems may be used. Rear leg 24 includes generally downwardly directed element 26 and diagonal element 28. Rear leg 24 abuts stop 30 attached to seat frame 16. Forward leg 32 is rotatably hinged at pin 34 to rear leg 24 and particularly to diagonal element 28 of the rear leg. Cross frame member 20 is hinged to back frame element 12 at hinge point 36. Because cross frame element 20 is hinged to back frame 12 and back frame 12 is hinged to seat frame 16, cross frame element 20 is pivotally connected between back frame 12 and seat frame 16. Diagonal element 28 may be considered mechanically associated with cross frame element 20. Cross frame element 20 includes a control plate 40 having several control surfaces, one of which is control surface 42. Rotation hinge pin 34 coupling diagonal frame element 28 and forward frame element 32 cooperates with the plurality of control surfaces, one of which is control surface 42 of control plate 40, in order to establish an angular seating position between back support frame 12 and seat support frame 16. Of course, from the perspective of user in region 19, the angular seating position is established between the flexible back support 14 and the flexible seat 18. Other constructions of the back support frame 12 and the seat support frame 16 and rear leg 24 and forward leg 22 can be utilized in conjunction with the present invention. For example cross frame 20 may cooperate with seat frame 16 in a foreshortened chair.

Figure 5:
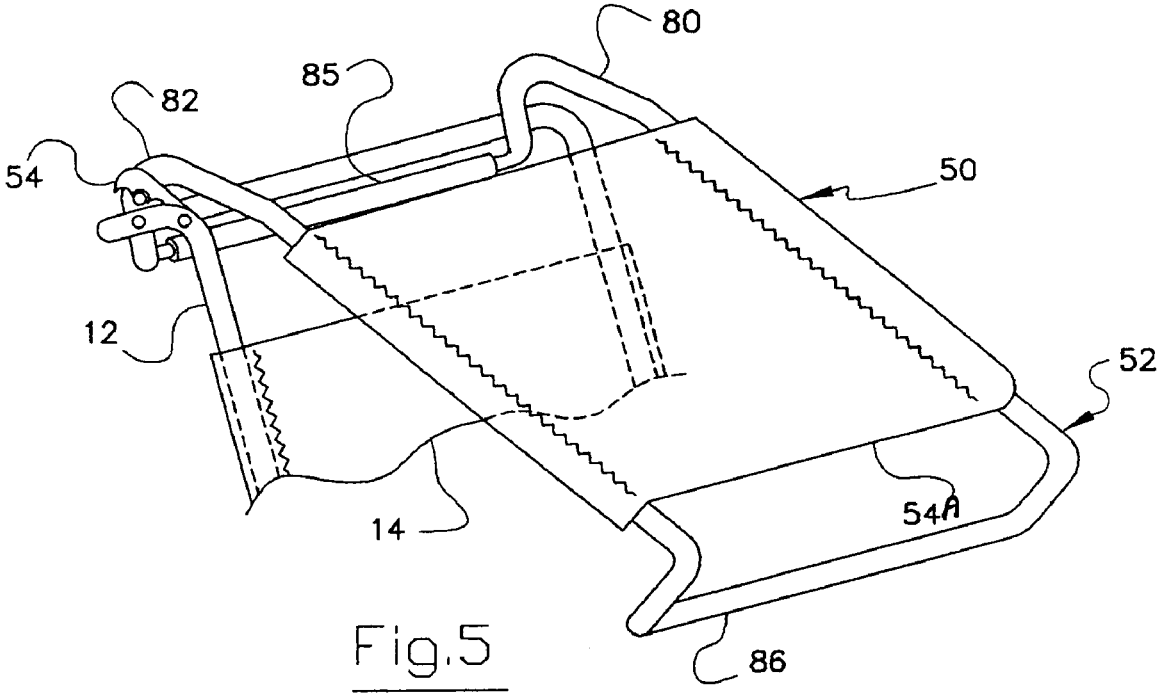
FIG. 5 diagrammatically illustrates a perspective view of the shade member and the back support frame and the flexible back support.

FIG. 1 also shows frame member 50 which includes shade frame 52 and a shade element 54. 54A. Shade element 54A is best illustrated in FIG. 5. Returning to FIG. 1, shade frame 52 is pivotally mounted to top region 51 of back frame 12 at pivotal or rotational hinge point 53. The angular position of shade member 50 is established based on control member 54. Control member 54, in the illustrated embodiment, is pivotally attached or hinged at point 56A to shade frame 52. Control member 54 has a plurality of control surfaces thereon, one of which is surface 56. The control surfaces on control member 54 cooperate with a pin or stop 58 attached to or protruding inboard from back support frame 12.

Figure 2:
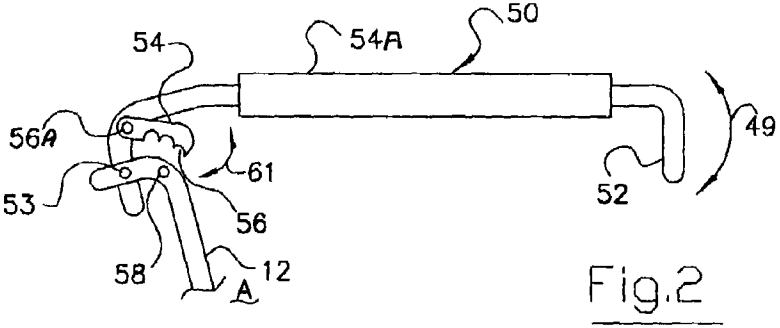
FIG. 2 diagrammatically illustrates a partial view of the shade member and the back frame as well as the control member pivotally mounted to the shade frame.

FIG. 2 illustrates a partial diagrammatic view of shade member 50 and back support frame 12. Similar numerals designate similar items throughout the drawings. In FIG. 2, control member 54 has been rotated upward or away from back support frame 12 revealing three (3) control surfaces, on of which is control surface 56. When control member 54 engages stop 58 at control surface 56, a maximum angular shade position is provided has noted by double headed arrow 61. When the intermediate control surface to the left of control surface 56 is cooperatively placed on stop 58, an intermediate, more acute, angular shade position is achieved between shade element 50 and back support frame 12. When the most inboard control surface is utilized by the seated person in region 19, the most acute angular shade position is achieved between shade element 50 and back support frame 12.

Figure 3:
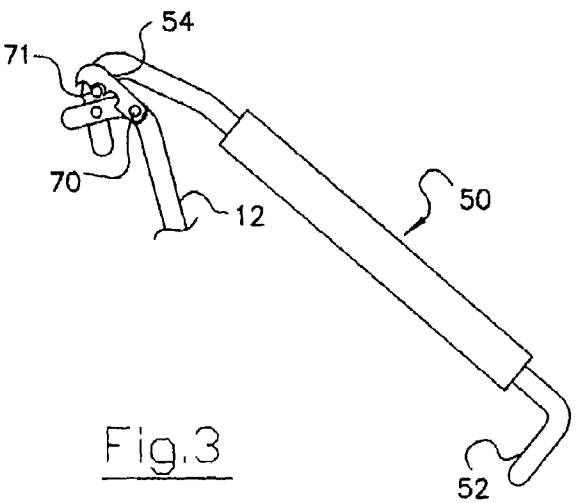
FIG. 3 diagrammatically illustrates a lowered shade position, that is, when the shade is closer to the back support.

FIG. 3 diagrammatically illustrates that control member 54 could be pivotally mounted or hinged on back support frame 12 at pivot 70 and the control surface could operate in conjunction pin 71 on shade frame 52.

FIG. 4 diagrammatically shows a portion of shade element 50 and particularly shade side frames 80 and 82 and shade rear frame element 84. A cushion 85 is mounted or fixed on rear shade frame element 84 such that a user seated in region 19 (FIG. 1) has some cushioning or soft element for the user's head.

FIG. 5 diagrammatically illustrates a perspective, partial view of shade element 50. Particularly, shade element 50 includes opposing side frame elements 80, 82, fore frame element 86 and a rear frame element that is substantially covered by cushion 85. A generally rectangular shade frame 80, 86, 82 and 84 is provided and shade element 54A covers most of the rectangular area.

Control member 54 can have a plurality of control surfaces to provide multiple angular shade positions for the user. Further, control member 54 can be fully rotated away such that control surface 56 and the other control surfaces are not interactive with pin 58 (FIG. 2) such that shade member 50 can be fully collapsed as shown by double headed arrow 49 in FIG. 2 such that shade element 50 can be positioned at adjacent position A near back support frame 12. When shade member 50 is collapsed to position A substantially against back support frame 12, the user can easily collapse the remainder of the folding chair 10, moving back support frame 12 to a position adjacent seat support frame 16 thereby enabling the user to carry the folding chair to other locations. Preferably, shade element 54A is cloth or nylon or synthetic material. Back support and seat support is made of the same cloth-like material. All frame members are aluminum in one embodiment.

The claims appended hereto are meant to cover modifications and changes withing the scope and spirit of the present invention.

What is claimed is:

1. A folding beach chair with a movable shade adapted for use by a seated person comprising:

a back support frame upon which is mounted a flexible back support for said seated person;

a seat support frame which upon which is mounted a flexible seat for said seated person, said seat support frame hinged to said back support frame;

a cross frame member pivotally mounted between said back support frame and said seat support frame to limit an angular seating position between said back support frame and said seat support frame;

a shade member having a shade member frame and shade element adapted to provide shade to said seated person, said shade member frame pivotally mounted to a top portion of said back support frame; and a control member coupled between said shade member frame and said back support member, said control member movably mounted on one of said shade member frame and said back support frame and said control member having a control surface operative on the other of said shade member frame and said back support frame such that said control member establishes an angular shade position between said shade member and said back support frame;

wherein said shade member frame generally frames a rectangular open space and includes a rear frame element and wherein said shade element covers a substantial portion of said rectangular open space, said rear frame element having a cushion member attached thereto.

2. A folding beach chair with a shade as claimed in claim 1 wherein said control surface cooperates with a stop mounted on said other of said shade member frame and said back support frame to establish said angular shade position.

3. A folding beach chair with a shade as claimed in claim 2 wherein said control surface has at least three operative surface segments and said angular shade position is one of at least three angular shade positions, said three surface elements cooperating with said stop.

4. A folding beach chair with a shade as claimed in claim 3 wherein said control member is rotatably mounted on said one of said shade member frame and said back support member.

5. A folding beach chair with a shade as claimed in claim 4 wherein said shade member frame frames an elongated rectangular open space.

6. A folding beach chair with a shade as claimed in claim 5 wherein the rectangular shade member has a fore frame element and opposing side frame elements coupled to said rear frame element.

7. A folding beach chair with a shade as claimed in claim 6 wherein said cushion member is disposed at least proximally with respect to said flexible back support.

8. A folding beach chair with a shade as claimed in claim 7 wherein said shade frame is rotatably mounted to said top portion of said back support frame such that said shade member has a first position collapsed adjacent said flexible back support and said angular shade position.

9. A folding beach chair with a shade as claimed in claim 1 wherein said control surface has at least three operative surface segments and said angular shade position is one of at least three angular shade positions.

10. A folding beach chair with a shade as claimed in claim 1 wherein said control member is rotatably mounted on said one of said shade member frame and said back support member.

11. A folding beach chair with a shade as claimed in claim 10 wherein the rectangular shade member has a fore frame element and opposing side frame elements coupled to said rear frame element.

12. A folding beach chair with a shade as claimed in claim 11 wherein said cushion member is disposed at least proximally with respect to said flexible back support.

13. A folding beach chair with a shade as claimed in claim 1 wherein said shade frame is rotatably mounted to said top portion of said back support frame such that said shade member has a first position collapsed adjacent said flexible back support and said angular shade position.

14. A light weight, collapsible folding chair with a movable shade adapted for use by a seated person comprising:

a back support frame upon which is mounted a flexible back support for said seated person;

a seat support frame which upon which is mounted a flexible seat for said seated person, said seat support frame hinged to said back support frame;

a cross frame member pivotally mounted between said back support frame and said seat support frame to limit an angular seating position between said back support frame and said seat support frame;

a shade member having a shade member frame with a rear frame element and shade element adapted to provide shade to said seated person and said rear frame element carrying a cushion thereon, said shade member frame pivotally mounted to a top portion of said back support frame; and a control member coupled between said shade member frame and said back support member, said control member movably mounted on one of said shade member frame and said back support member and said control member having a control surface operative on the other of said shade member frame and said back support member such that said control member establishes an angular shade position between said shade member and said back support frame.

15. A folding beach chair with a movable shade adapted for use by a seated person comprising:

a back support frame upon which is mounted a flexible back support for said seated person;

a seat support frame which upon which is mounted a flexible seat for said seated person, said seat support frame hinged to said back support frame;

a cross frame member pivotally mounted between said back support frame and said seat support frame to limit an angular seating position between said back support frame and said seat support frame;

a shade member having a shade member frame and shade element adapted to provide shade to said seated person, said shade member frame pivotally mounted to a top portion of said back support frame; and a control member formed as a swing plate coupled between said shade member frame and said back support member, said control member swing plate movably mounted on one of said shade member frame and said back support frame and said control member swing plate having curvaceous cut-outs as a control surface operative on the other of said shade member frame and said back support frame such that said control member swing plate establishes an angular shade position between said shade member and said back support frame;

wherein the rectangular shade member has peripheral frame elements including a rear frame element and said rear frame element having a cushion member attached thereto.

16. A folding beach chair with a shade as claimed in claim 15 wherein said control surface cooperates with a stop mounted on said other of said shade member frame and said back support frame to establish said angular shade position.

17. A folding beach chair with a shade as claimed in claim 15 wherein said control surface has at least three operative surface segments and said angular shade position is one of at least three angular shade positions.

18. A folding beach chair with a shade as claimed in claim 15 wherein said control member is rotatably mounted on said one of said shade member frame and said back support member.

19. A folding beach chair with a shade as claimed in claim 15 wherein said shade member frame generally frames a rectangular open space and wherein said shade element covers a substantial portion of said rectangular open space.

20. A folding beach chair with a shade as claimed in claim 19 wherein said peripheral frame elements has a fore frame element, a rear frame element and opposing side frame elements, said rear frame element having said cushion member attached thereto.

21. A folding beach chair with a shade as claimed in claim 20 wherein said cushion member is disposed at least proximally with respect to said flexible back support.

22. A folding beach chair with a shade as claimed in claim 15 wherein said shade frame is rotatably mounted to said top portion of said back support frame such that said shade member has a first position collapsed adjacent said flexible back support and said angular shade position.

* * * * *